US005441105A

United States Patent [19]

Brummett et al.

[11] Patent Number: 5,441,105

[45] Date of Patent: Aug. 15, 1995

[54] FOLDED PARALLEL FLOW CONDENSER TUBE

[75] Inventors: Keiv P. Brummett, Atoka, Okla.; Harold A. Carpenter, Jr., Fort Worth, Tex.; Scott L. Hutto; John M. McCrady, both of Burleson, Tex.

[73] Assignee: Wynn's Climate Systems, Inc.

[21] Appl. No.: 155,079

[22] Filed: Nov. 18, 1993

[51] Int. Cl.[6] ..... F28D 1/03; F28F 1/40

[52] U.S. Cl. ..... 165/153; 165/170; 165/173; 165/177

[58] Field of Search ..... 165/151, 152, 153, 173, 165/177, 170; 29/890.093, 890.045, 890.046, 890.053, 890.039

[56] References Cited

U.S. PATENT DOCUMENTS

| | | | |
|---|---|---|---|
| 349,060 | 9/1886 | Serve | 165/179 |
| 1,215,793 | 2/1917 | Gabrielson | 165/152 |
| 1,302,627 | 5/1919 | Boblett | 165/152 |
| 1,316,199 | 9/1919 | Spery | 165/152 |
| 1,951,366 | 4/1929 | Muir | 165/148 |
| 2,017,201 | 10/1935 | Bossart et al. | 165/177 |
| 2,093,256 | 9/1937 | Still | 165/152 |
| 2,151,540 | 3/1939 | Varga | 138/117 |
| 2,957,679 | 10/1960 | Campbell | 29/890.039 |
| 3,757,856 | 9/1973 | Kun | 165/166 |
| 4,470,452 | 9/1984 | Rhodes | 165/153 |
| 4,600,053 | 7/1986 | Patel et al. | 165/170 |
| 4,805,693 | 2/1989 | Flessate | 165/153 |
| 4,932,469 | 6/1990 | Beatenbough | 165/153 |
| 5,101,891 | 4/1992 | Kadle | 165/153 X |
| 5,152,337 | 10/1992 | Kawakatsu | 165/153 |
| 5,172,476 | 12/1992 | Joshi | 29/890.053 |
| 5,172,759 | 12/1992 | Shimoya et al. | 165/110 |
| 5,185,925 | 2/1993 | Ryan et al. | 29/890.049 |
| 5,186,250 | 2/1993 | Ouchi et al. | 165/177 |
| 5,271,151 | 12/1993 | Wallis | 29/890.053 |

FOREIGN PATENT DOCUMENTS

| | | | |
|---|---|---|---|
| 573208 | 6/1924 | France | 165/177 |
| 4015830 | 11/1991 | Germany | 165/153 |
| 136093 | 8/1982 | Japan | 165/177 |
| 356279 | 9/1931 | United Kingdom | 165/170 |
| 2256471 | 9/1992 | United Kingdom | 165/153 |

*Primary Examiner*—Martin P. Schwadron
*Assistant Examiner*—L. R. Leo
*Attorney, Agent, or Firm*—Grady K. Bergen

[57] ABSTRACT

A heat exchanger is provided with a set of oppositely disposed header pipes into which a plurality of parallel cross flow tubes are inserted and joined to provide fluid communication between the header pipes. Fluid enters the header pipes and flows through the tubes, wherein it is cooled by air passing over the tubes. The tubes are constructed from two separate plates, each plate having a plurality of non-continuous ridges, which are joined together to form a single substantially flat tube having an upper wall and a lower wall. The ridges are oriented along each wall of the tube in substantially oblique configurations, relative to the longitudinal axis of the tube, so that upstream ends of the ridges in each configuration are aligned in a substantially oblique line which extends across the width of the tube.

19 Claims, 2 Drawing Sheets

FOLDED PARALLEL FLOW CONDENSER TUBE

BACKGROUND OF THE INVENTION

1. Field of the Invention

This invention relates to an air conditioning condenser for use in an automobile.

2. Description of the Prior Art

Serpentine air conditioning condensers of the type used in automobiles, in the past, have been constructed using a single flow tube having a circular cross-sectional area through which the cooling fluid to be condensed was passed. The tube had to be of a sufficient length to provide enough surface area for heat to be effectively transferred from the cooling fluid to the surrounding air as the cooling fluid flowed through the condenser. To minimize the amount of space the condenser occupied, the flow tube would usually have several turns or bends so that portions of the tube were parallel with one another.

Air conditioning condensers employing the single serpentine flow tube had severe limitations. Because the cooling fluid had to pass through a single tube, the tube had to have a fairly large cross-sectional area to maintain an acceptable pressure drop through the heat exchanger. This required that the flow tube be quite long to provide enough surface area for effective heat transfer to occur.

Multi-pass, parallel flow air conditioning condensers have overcome some of the limitations of the single tube condensers. These parallel flow air conditioning condensers cause the cooling fluid to be cooled more efficiently within a smaller amount of space. Typically, the parallel flow condensers consist of a set of header pipes which are connected to a set of parallel tubes. Baffles are provided in each header pipe to direct the fluid through banks of several of the parallel cross flow tubes. Because the fluid passes through several tubes instead of a single tube, the cross flow tubes can have a much smaller cross-sectional area while providing a much larger amount of surface area for heat transfer.

Cross flow tubes of the type described are usually substantially flat, extruded aluminum tubes. These tubes are usually arranged so that cooling air flows across the width of the tube from one edge to another. The most efficient cooling takes place at the edges of the tube where there is more surface area contact with the surrounding air. This is especially true along the lead edge of the tube where the air first contacts the tube.

The cross flow tubes used for the parallel flow condensers often have partitions or webs which are formed along the length of the tube and divide the interior of each tube into several longitudinal flow passages through which the cooling fluid flows. The partitions or webs strengthen the tubes, which could otherwise be damaged by the extreme high pressure of the cooling fluid. Because these partitions or webs extend longitudinally along the length of the tube, fluid flowing through interior passages of the tube is not cooled as effectively as the fluid flowing along the leading edges where the air first contacts the tube.

SUMMARY OF THE INVENTION

This invention provides an air conditioning condenser having a pair of oppositely disposed header pipes. The header pipes have a plurality of slots extending along the length of each pipe. A plurality of generally parallel, substantially flat tubes are also provided, each tube having a downstream end and an upstream end. Each tube has a longitudinal axis and opposite facing upper and lower walls which are parallel to each other and are joined together along longitudinally extending leading and trailing side edges relative to air movement over the tube. The downstream end and the upstream end of each tube are inserted into the slots of the oppositely disposed header pipes and sealingly joined thereto for providing fluid communication between the header pipes.

Inwardly protruding folds or ridges are formed from inward bent portions of the upper and lower walls and protrude inwardly from the inner surface of each of the upper and lower walls toward the other of the upper and lower walls. The ridges are non-continuous and have lengths which are substantially less than the length of each wall and which are parallel to the longitudinal axis of the tube. The ridges are laterally spaced apart along the upper and lower walls and are staggered along the length of each wall so that the upstream ends of the ridges are aligned along substantially oblique lines which extend across the width of each of the upper and lower walls. This causes fluid flowing through each tube to be directed across the width of the tube. To give each tube structural integrity, the ridges of the upper wall contact and join the ridges of the lower wall.

DETAILED DESCRIPTION OF THE INVENTION

Figure 1:
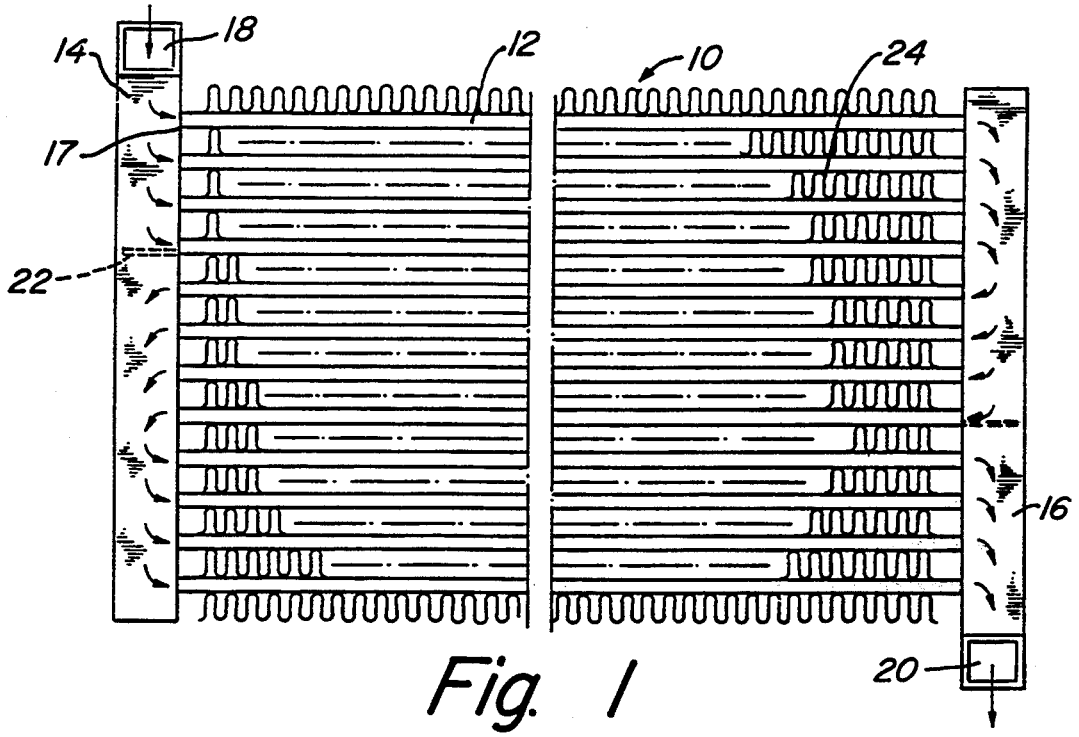
FIG. 1 is a front side view of an air conditioning condenser constructed in accordance with the invention.

Referring to the figures, FIG. 1 shows an air conditioning condenser 10 having a set of generally parallel cross flow tubes 12. The tubes 12 are joined to oppositely disposed header pipes 14, 16 with the tubes 12 inserting into slots 17 extending along the length of each header pipe 14, 16. An inlet 18 for conducting cooling fluid into the heat exchanger 10 is formed in the header pipe 14 and an outlet 20 for directing fluid out of the condenser 10 is formed in header pipe 16. Baffles or partitions 22 are provided in the header pipes 14, 16 for diverting fluid flow through banks of the parallel tubes 12. Convoluted fins 24 are attached to the exterior each of the tubes 12 and serve as a means for conducting heat away from the tubes 12 while providing additional surface area for convective heat transfer by air flowing over the condenser 10. The fins 24 are disposed between each of the parallel tubes 12 of the condenser 10.

Figure 2:
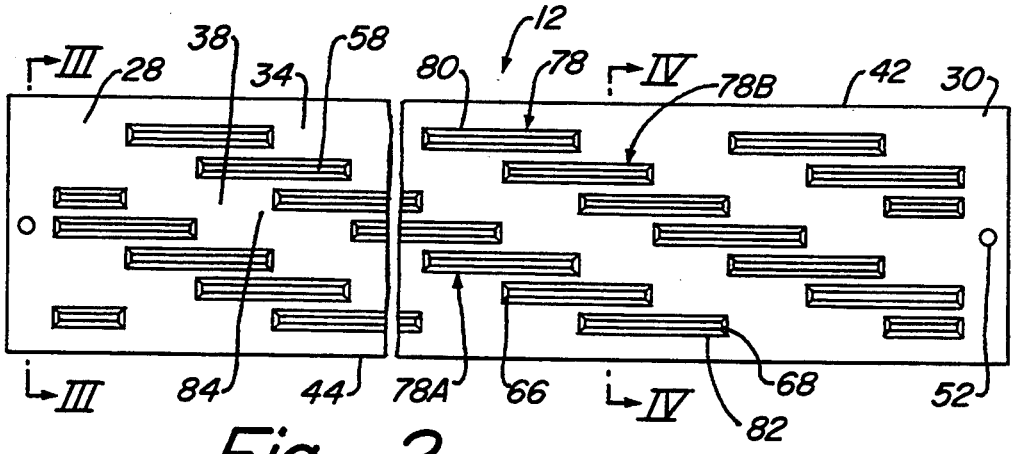
FIG. 2 is a top plan view of a cross flow tube constructed in accordance with the invention.
Figure 3:
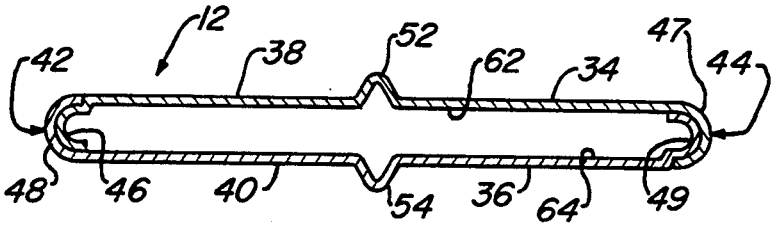
FIG. 3 is a cross-sectional view of the tube of FIG. 2 taken along the lines III—III.
Figure 4:
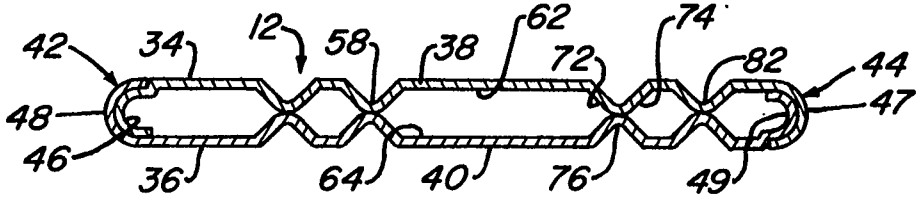
FIG. 4 is a cross-sectional view of the tube of FIG. 2 taken along the lines IV—IV.

Referring to FIGS. 2–4, each of the tubes 12 is substantially flat. As viewed in FIG. 2, the left end 28 is a downstream end and the right end 30 is an upstream end. The terms "upstream" and "downstream" are used herein for convenience and refer to direction of fluid flow through the tubes 12. As can best be seen in FIGS. 3 and 4, each of the tubes 12 is formed from an upper plate 34 and a lower plate 36 which are joined together. The upper plate 34 forms an upper wall 38 and the lower plate 36 forms a lower wall 40 which faces opposite the upper wall 38. Longitudinally extending side edges 42, 44 of the tube 12 are formed by curved portions 46, 47 of the upper plate 34 extending from either side of the upper wall 38 and curved portions 48, 49 of the lower plate 36 extending from either side of the lower wall 40. The curved portions 46, 47 of the upper plate 34 overlap and join the curved portions 48, 49 of the lower plate 36 thereby joining the upper and lower plates 38, 40 together. The side edge 42 is a leading side edge over which air first passes and the side edge 44 is a trailing side edge.

Referring to FIGS. 2 and 3, the downstream end 28 and upstream end 30 of each tube 12 has upper and lower protuberances or projections 52, 54. The protuberances 52, 54 protrude outwardly from the exterior surface of each of the upper and lower walls 38, 40 and are located an equidistance from either edge 42, 44. The projections 52, 54 formed on the upper and lower walls 38, 40 at each end 28, 30 of the tube 12 serve as stops which prevent the tubes 12 from being inserted too deeply into the slots 17 of the header pipes 14, 16.

A plurality of non-continuous, inwardly protruding folds or ridges 58 are formed from inward bent portions of the upper and lower walls 38, 40, as can be seen in FIGS. 2 and 4. The inwardly protruding ridges 58 protrude from inner surfaces 62, 64 of the upper and lower walls 38, 40, respectively. Although not shown in FIG. 2, the lower wall 40 is a mirror image of the upper wall 38. The ridges 58 are substantially straight and are of equal length, the length of each of the ridges 58 being substantially less than the length of the upper and lower walls 38, 40 of each tube 12. The ridges 58 are parallel to the longitudinal axis of the tube 12 and to the first and second side edges 42, 44.

The ridges 58 each have a downstream end 66 and an upstream end 68. Each ridge 58 has converging sides 72, 74, as shown in FIG. 4, which converge at less than a ninety degree angle from the inner surface 62, 64 of each of the upper and lower walls 38, 40 to form an innermost extremity or peak 76 which extends along the length of each ridge 58 from the downstream end 66 to the upstream end 68. Each of the ridges 58 of the upper wall 38 contacts and is joined to one of the ridges 58 of the lower wall 40 along the innermost extremity 76 when the upper and lower plates 34, 36 are joined together. Each of the upper and lower ridges 58, which are joined together, form a single barrier and support structure within the interior of each tube 12.

The ridges 58 are laterally spaced apart across the width of each wall 38, 40 and are staggered along the length of each wall 38, 40 to form discrete parallel oblique configurations 78. Each oblique configuration 78 extends across the width of the walls 38, 40. The downstream ends 66 and upstream ends 68 of the ridges 58 in each configuration 78 are aligned in substantially oblique, parallel lines relative to the longitudinal axis of the tube 12 which extend across the width of each wall 38, 40. The ends 28, 30 of the tubes 12, where the tubes 12 are inserted into the slots 17 of the header pipes 14, 16, have no ridges formed on them.

The ridges 58 closest to the leading side edge 42 in each configuration 78 form leading ridges and are designated by the numeral 80. The ridges 58 closest to the trailing edge 44 in each configuration 78 form trailing ridges and are designated by the numeral 82. The leading ridges 80 are located downstream of the trailing ridges 82, with the upstream ends 68 of the leading ridges 80 being located downstream along the tube 12 of the upstream ends 68 of the trailing ridges 82, within each configuration 78. The intermediate ridges 58 located between the leading and trailing ridges 80, 82 in each configuration 78 are staggered at various degrees with each adjacent ridge 58 longitudinally overlapping the other.

The parallel configurations 78 in FIG. 2 are each identical and are repeated along the length of the tube 12. Adjacent configurations 78 are designated with an A or a B. As shown in FIG. 2, the adjacent configurations 78A and 78B are spaced apart from each other to define a flow space 84 between the downstream ends 66 of the ridges 58 in the adjacent upstream configuration 78B and the upstream ends 68 of the ridges 58 in the adjacent downstream configuration 78A. The flow space 84 extends along a substantially oblique line cross the width of the tube 12. The flow spaces 84 lead toward the leading edge 42.

The configurations 78A, 78B are longitudinally overlapped so that the upstream end 68 of the trailing ridge 82 in the adjacent downstream configuration 78A longitudinally overlaps the downstream end 66 of at least one of the ridges 58 in the adjacent upstream configuration 78B. Likewise, the downstream end 66 of the leading ridge 80 in the adjacent upstream configuration 78B overlaps at least one of the ridges 58 in the adjacent downstream configuration 78A.

The method of forming the air conditioning condenser 10 of FIGS. 1–4 is as follows. The headers 14, 16 are formed from aluminum which is clad with a brazing compound using conventional methods. Slots 17 are formed in the header pipes 14, 16 and baffles or partitions 22 are positioned within the header pipes 14, 16 where desired to conduct flow fluid through the tubes 12.

The tubes 12 are formed by providing two substantially identical flat aluminum sheets which are clad with a brazing compound. The two sheets of aluminum form the upper and lower plates 34, 36 and are cut to desired lengths and widths. Prior to joining the upper and lower plates 34, 36 together, ridges 58 are formed by stamping the ridges 58 into the plates 34, 36 in the configurations 78 shown in FIG. 2 and described above. It should be noted that the pattern of ridges 58 formed on the upper and lower plates 34, 36 are formed in the reverse mirror image of each other. This is done so that the ridges 58 on the upper wall 38 correspond or match with the ridges 58 on the lower wall 40 when the plates 34, 36 are joined together. The projections 52, 54 are also formed by stamping the ends 28, 30 of the upper and lower plates 34, 36.

The curved portion 46 on the upper plate 34 and curved portion 49 on the lower plate 36 are formed by bending the edges of the plates 34, 36 which are to be diagonally opposite each other when the plates 34, 36 are joined together. The plates 34, 36 are then positioned so that the ridges 58 on the upper plate 34 are aligned and contact the ridges 58 of the lower plate 36.

The curved edges of the upper and lower plates 34, 36 are then bent to form curved portions 47 and 48 which overlap and contact curved portion 49 and curved portion 46, respectively, the curved portion 46 of the upper plate 34 being interior of the curved portion 48 of the lower plate 36, and the curved portion 49 of the lower plate 36 being located interior of the curved portion 47 of the upper plate 34. It should be noted that the interior curved portions 46, 49 have a radius of curvature which is smaller than the radius of curvature of the outer curved portions 47, 48. When the curved portions 46, 47, 48, 49 are overlapped as described, the upper and lower plates 34, 36 are effectively joined together and the ridges 58 of the upper and lower walls 38, 40 are in contacting relationship with each other along the innermost extremity 76.

After the upper and lower plates 34, 36 are joined together by overlapping the curved portions 46, 47, 48, 49, the ends 28, 30 of the tubes 12 are inserted into the slots 17 of the header pipes 14, 16 with the upper and lower protuberances 52, 54 abutting against the header pipes 14, 16 to prevent the tubes 12 from being inserted too deeply into the slots 17. The convoluted fins 24, also clad with a brazing compound, are then positioned along the exterior of the upper and lower walls 38, 40 between each of the tubes 12.

When the tubes 12 are inserted into the header pipes 14, 16 and the fins are positioned between the tubes 12, the air conditioning condenser 10 can be heated above the melting point of the claded brazing compound on each of the components. This causes the brazing compound to melt and flow into the interstices of any adjoining areas between the components of the condenser 10. When the brazing compound cools and hardens, the ends 28, 30 of the tubes 12 are sealingly engaged with the slots 17, and the fins 24 are joined to the upper and lower walls 38, 40 of the tubes 12. The overlapping curved portions 46, 47, 48, 49, forming the side edges 42, 44, are also joined and sealed together, and the ridges 58 of the upper and lower walls 38, 40 are joined together.

In constructing the air conditioning condenser 10, each tube 12 should be oriented between the header pipes 14, 16 so that cooling fluid is introduced into the upstream end 30 of the tube 12, as shown in FIG. 2, and flows to the downstream end 28 with the side edge 42 being the leading edge over which the cooling air initially passes when flowing over the exterior of the flow tubes 12.

The operation of the air conditioning condenser 10 is as follows. High pressure cooling fluid, which is to be condensed, is introduced into the air conditioning condenser 10 through inlet 18 of the header pipe 14. The cooling fluid flows through the header pipe 14 until it reaches one of the baffles 22 wherein the fluid is directed through the upstream ends 30 of an upper bank of the tubes 12 to header pipe 16. The fluid flows out of the downstream ends 28 of the upper bank of tubes 12 and into the header pipe 16 where the fluid contacts a second baffle 22. The fluid is then directed through the upstream ends 30 of a second bank of cross flow tubes 12. By positioning several baffles 22 within the header pipes 14, 16 the fluid can be passed back and forth between the header pipes through several banks of tubes so that the cooling fluid is completely condensed before exiting the outlet 20 of the header pipe 16.

As fluid flows through each of the cross flow tubes 12, from the upstream end 30 to the downstream end 28, the fluid contacts the upstream ends 68 of the ridges 58 which causes some of the fluid to be directed through the flow space 84 towards the leading side edge 42, as shown by the arrows in FIG. 2. Thus, as fluid continues to flow through the length of each tube 12, the fluid is prevented from flowing in a substantially straight path along the length of the tube 12, and instead is continually forced by the oblique configurations 78 of ridges 58 toward the leading edge 42. As ambient cooling air passes over the tubes 12, the air is gradually heated as it absorbs heat from the surface of the tubes 12. Because the air contacting the leading edge 42 of the tubes 12 is cooler, heat is transferred more effectively near the leading edge 42.

Figure 5:
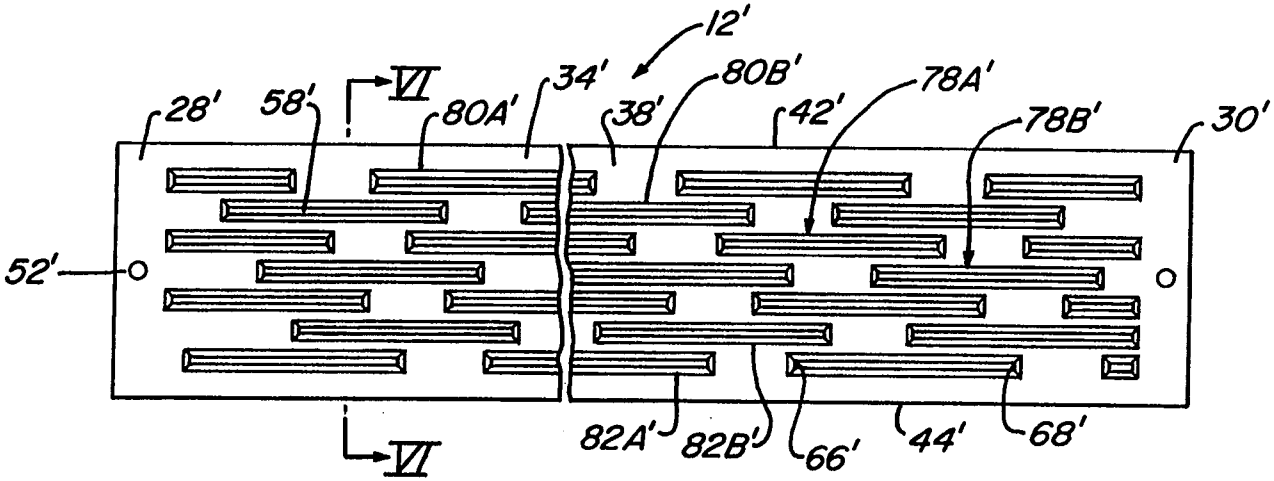
FIG. 5 is another embodiment of the tube of the air conditioning condenser constructed in accordance with the invention.
Figure 6:
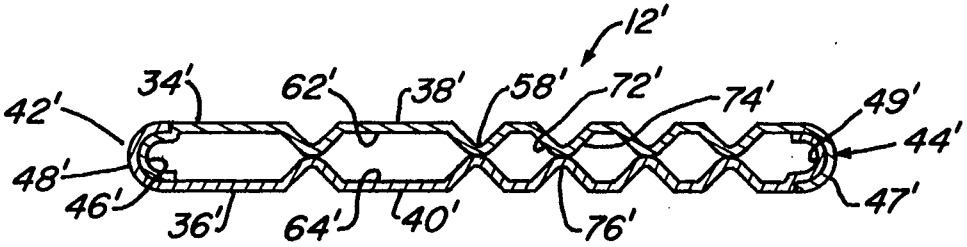
FIG. 6 is a cross-sectional view of the tube of FIG. 5 taken along the lines VI—VI.

FIG. 5 shows another embodiment of a cross flow tube 12′ for the air conditioning condenser 10. The components of the cross flow tube 12′ of FIGS. 5 and 6 are similar to those of the cross flow tube 12 of FIGS. 2–4 and are designated with a prime sign. The ridges 58′ are laterally spaced apart across the width of the upper and lower walls 38′, 40′ and are staggered along the length of the upper and lower walls 38′, 40′ so that the ridges 58′ are arranged in alternating oblique configurations 78A′, 78B′, relative to the longitudinal axis of the tube 12′. The downstream and upstream ends 66′, 68′ of the ridges 58′ of each configuration 78A′, 78B′ are also aligned along oblique lines which extend across the width of the upper and lower walls 38′, 40′.

Each of the ridges 58′ in each configuration 78A′, 78B′ partially overlaps the ridges 58′ of the adjacent configuration 78A′, 78B′. The downstream ends 66′ of the ridges 58′ in the adjacent upstream configuration 78B′ longitudinally overlap and are interlaced between the upstream ends 68′ of the ridges 58′ in the configuration 78A′. The upstream ends 68′ of the ridges 58′ in the configuration 78A′, which are located downstream of the configuration 78B′, overlap and are interlaced between the downstream ends 66′ of the ridges 58′ in the configuration 78B′.

The leading ridge 80B′ of each configuration 78B′ longitudinally overlaps the trailing ridge 82A′ of the downstream adjacent configuration 78A′. Likewise, the leading ridge 80A′ of each configuration 78A′ longitudinally overlaps the trailing ridge 82B′ of the downstream adjacent configuration 78B′.

The construction and operation of the air conditioning condenser 10 employing the tubes 12′ is substantially the same as described for the tubes 12.

The air conditioning condenser of this invention has advantages over the prior art in that, by providing a plurality of non-continuous ridges having lengths which are substantially less than the length of the tube, fluid can be directed from one end of the tube to the other along a flow path which is not parallel with the longitudinal axis of the tube. The ridges provide a barrier to the flow in the tube so that the flow is directed across the width of the tube instead of along a longitudinal path which extends the length of the tube. By orienting the ridges in oblique configurations, the fluid can be directed toward the edge of the tube where more efficient cooling takes place.

While the invention has been shown in only some of its forms, it should be apparent to those skilled in the art that it is not so limited, but is susceptible to various changes without departing from the scope of the invention.

We claim:

1. A heat exchanger comprising in combination:

a pair of oppositely disposed header pipes having a plurality of slots extending along the length of each pipe;

a set of generally parallel, substantially flat tubes, each tube having a longitudinal axis and opposite facing upper and lower walls which are parallel to each other and joined together along longitudinally extending leading and trailing side edges relative to the direction of air movement over the tube, each tube having an upstream end and a downstream end which are inserted into the slots and joined to the header pipes for providing fluid communication between the header pipes; and a plurality of inwardly protruding ridges which protrude from an inner surface of at least one of the upper and lower walls of each tube toward the other of the upper and lower walls, each of the ridges having a length that is substantially less than the length of each wall, each of the ridges having an upstream end and a downstream end, the ridges being laterally spaced apart and being staggered along the length of said at least one of the upper and lower walls so that the upstream ends of laterally adjacent ridges are spaced at different distances to the upstream end of the tube and the downstream ends of the laterally adjacent ridges are spaced at different distances to the downstream end of the tube, the ridges forming discrete configurations in which the upstream ends of the ridges in each configuration are aligned along a substantially oblique line which extends across the width of each of the upper and lower walls so that fluid flowing through the tube is directed toward the leading side edge of the tube; and wherein the ridges in each configuration interlacing longitudinally with the ridges in adjacent upstream and downstream configurations, and the ridges in every second laterally spaced apart ridge having upstream ends aligned along a substantially oblique line.

2. The heat exchanger of claim 1, wherein:

each of the ridges protrude from both the upper wall and the lower wall; and each of the ridges of the upper wall is joined to the ridges of the lower wall.

3. The heat exchanger of claim 1, wherein:

all of the ridges are parallel to the longitudinal axis of the tube.

4. The heat exchanger of claim 1, wherein:

the ridges are formed from inward bent portions of said at least one of the upper and lower walls.

5. The heat exchanger of claim 1, wherein:

the upstream ends of the ridges nearest to the leading side edge are located downstream of the upstream ends of the ridges nearest to the trailing side edge in each configuration.

6. The heat exchanger of claim 1, wherein:

the ridges within each configuration are of equal length.

7. The heat exchanger of claim 1, wherein:

each of the configurations has a leading ridge and a trailing ridge and at least one intermediate ridge located therebetween, the leading ridge being located closer to the leading side edge of the tube than the trailing ridge, and wherein at least one of the ridges in each of the configurations longitudinally overlaps at least one of the ridges in the other configurations.

8. The heat exchanger of claim 7, wherein:

the leading ridge of each of the configurations longitudinally overlaps the trailing ridge of the adjacent downstream configuration.

9. The heat exchanger of claim 7, wherein:

the upstream end of each ridge in each configuration longitudinally overlaps the downstream end of at least one of the ridges in the adjacent upstream configuration.

10. A heat exchanger comprising in combination:

a pair of oppositely disposed header pipes having a plurality of slots extending along the length of each pipe;

a set of generally parallel, substantially flat tubes, each tube having a longitudinal axis and opposite facing upper and lower walls which are parallel to each other and joined together along longitudinally extending leading and trailing side edges relative to air movement over the tube, each tube having a downstream end and an upstream end which are inserted into the slots and joined to the header pipes for providing fluid communication between the header pipes; and a plurality of inwardly protruding ridges formed from portions of the upper and lower walls which protrude from an inner surface of each of the upper and lower walls toward the other of the upper and lower walls, each of the ridges of the upper wall being bonded along its entire length to one of the ridges of the lower wall, each of the ridges having a length that is substantially less than the length of each wall and which is parallel to the longitudinal axis, each of the ridges having a downstream end and an upstream end, the ridges being laterally spaced apart and being staggered along the length of each wall so that the ridges form discrete configurations in which the upstream ends of the ridges in each configuration are aligned along a substantially oblique line which extends across the width of each of the upper and lower walls so that fluid flowing through the tube is directed toward the leading side edge of the tube; and wherein the ridges in each configuration interlace longitudinally with the ridges in adjacent upstream and downstream configurations, and the ridges in every second laterally spaced apart ridge having upstream ends aligned along a substantially oblique line.

11. The heat exchanger of claim 10, wherein:

the upstream end of each ridge in each configuration longitudinally overlaps the downstream end of at least one of the ridges in the adjacent upstream configuration.

12. The heat exchanger of claim 10, wherein:

each of the configurations has a leading ridge and a trailing ridge and at least one intermediate ridge located therebetween, the leading ridge being located closer to the leading side edge of the tube than the trailing ridge, the upstream end of the leading ridge being located downstream of the upstream end of the trailing ridge.

13. The heat exchanger of claim 12, wherein:

the leading ridge of each configuration longitudinally overlaps the trailing ridge of the downstream adjacent configuration.

14. The heat exchanger of claim 10, wherein:

the ridges in each configuration are of equal length.

15. A heat exchanger comprising in combination:

a pair of oppositely disposed header pipes having a plurality of slots extending along the length of each pipe;

a set of generally parallel, substantially flat tubes, each tube having a longitudinal axis and opposite facing upper and lower walls which are parallel to each other and joined together along longitudinally extending leading and trailing side edges relative to air movement over the tube, each tube having a downstream end and an upstream end which are inserted into the slots and joined to the header pipes for providing fluid communication between the header pipes; and a plurality of inwardly protruding ridges formed from inward bent portions of the upper and lower walls which protrude from an inner surface of each of the upper and lower walls, each of the ridges having a length that is substantially less than the length of each wall and which are parallel to the longitudinal axis, each of the ridges having a downstream end and an upstream end, the ridges being laterally spaced apart and being staggered along the length of each wall so that the ridges form discrete parallel configurations in which the upstream ends of the ridges in each configuration are aligned along a substantially oblique line which extends across the width of each of the upper and lower walls, the ridges of the upper wall contacting, being parallel to and joining the ridges of the lower wall, and at least one of the ridges in each of the configurations longitudinally overlapping at least one of the ridges in the other configurations so that fluid flowing through the tube is directed toward the leading side edge of the tube; and wherein the ridges in each configuration interlace longitudinally with the ridges in adjacent upstream and downstream configurations, and the ridges in every second laterally spaced apart ridge having upstream ends aligned along a substantially oblique line.

16. The heat exchanger of claim 15, wherein:

the upstream end of each ridge in each configuration longitudinally overlaps the downstream end of at least one of the ridges in the adjacent upstream configuration.

17. The heat exchanger of claim 15, wherein:

each of the configurations has a leading ridge and a trailing ridge and at least one intermediate ridge located therebetween, the leading ridge being located closer to the leading side edge of the tube than the trailing ridge, the upstream end of the leading ridge being located downstream of the upstream end of the trailing ridge.

18. The heat exchanger of claim 17, wherein:

the leading ridge of each configuration longitudinally overlaps the trailing ridge of the downstream adjacent configuration.

19. The heat exchanger of claim 15, wherein:

the ridges in each configuration are of equal length.

* * * * *